US011517120B1

(12) United States Patent
Gonzalez

(10) Patent No.: US 11,517,120 B1
(45) Date of Patent: Dec. 6, 2022

(54) WIRELESSLY-CONTROLLED ELECTRIC BLANKET

(71) Applicant: Cynthia Gonzalez, Bronx, NY (US)

(72) Inventor: Cynthia Gonzalez, Bronx, NY (US)

( * ) Notice: Subject to any disclaimer, the term of this patent is extended or adjusted under 35 U.S.C. 154(b) by 786 days.

(21) Appl. No.: 16/525,699

(22) Filed: Jul. 30, 2019

(51) Int. Cl.
*A47C 21/04* (2006.01)
*H05B 3/34* (2006.01)
*H05B 1/02* (2006.01)

(52) U.S. Cl.
CPC ..... *A47C 21/048* (2013.01); *H05B 1/0272* (2013.01); *H05B 3/342* (2013.01); *H05B 2203/014* (2013.01)

(58) Field of Classification Search
CPC ..... A47C 27/00; A47C 31/123; A47C 27/12; A47C 27/22; A47C 7/748
See application file for complete search history.

(56) References Cited

U.S. PATENT DOCUMENTS 5,986,243 A 11/1999 Campf
6,078,026 A 6/2000 West
6,768,086 B2 7/2004 Sullivan
7,405,378 B1 7/2008 Whitlow
D628,425 S 12/2010 Inui
8,648,280 B1 2/2014 DeWitt
2003/0052120 A1* 3/2003 Zabrowsky ..... G05D 23/1905 219/501
2006/0166082 A1 7/2006 Turner
2007/0145036 A1 6/2007 Ratliff-Harris
2007/0257018 A1 11/2007 Huang
2011/0220634 A1* 9/2011 Yeh ..... A43B 3/34 219/482
2012/0112531 A1* 5/2012 Kesler ..... H02J 7/025 307/9.1
2016/0087687 A1* 3/2016 Kesler ..... H02J 50/80 307/104
2016/0344196 A1* 11/2016 Ahmad ..... A47C 1/00
2017/0179771 A1* 6/2017 Leabman ..... H02J 50/20

* cited by examiner

*Primary Examiner* — Jermele M Hollington
*Assistant Examiner* — Temilade S Rhodes-Vivour
(74) *Attorney, Agent, or Firm* — Kyle A. Fletcher, Esq.

(57) ABSTRACT

The wirelessly-controlled electric blanket is a domestic article. The wirelessly-controlled electric blanket is a textile structure known as a blanket. The wirelessly-controlled electric blanket is an electrically powered device known as an electric blanket. The wirelessly-controlled electric blanket comprises a blanket and a personal data device. The personal data device controls the operation of the blanket.

18 Claims, 4 Drawing Sheets

WIRELESSLY-CONTROLLED ELECTRIC BLANKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles including ventilating, cooling and heating methods associated with a bedstead, more specifically, a heating device for a bed. (A47C21/048)

SUMMARY OF INVENTION

The wirelessly-controlled electric blanket is a domestic article. The wirelessly-controlled electric blanket is a textile structure known as a blanket. The wirelessly-controlled electric blanket is an electrically powered device known as an electric blanket. The wirelessly-controlled electric blanket is an independently powered electric device. By independently powered is meant that the wirelessly-controlled electric blanket can operate without an electrical connection to an external electric power supply. The wirelessly-controlled electric blanket comprises a blanket and a personal data device. The personal data device controls the operation of the blanket. The personal data device forms a wireless communication link with the blanket.

These together with additional objects, features and advantages of the wirelessly-controlled electric blanket will be readily apparent to those of ordinary skill in the art upon reading the following detailed description of the presently preferred, but nonetheless illustrative, embodiments when taken in conjunction with the accompanying drawings.

In this respect, before explaining the current embodiments of the wirelessly-controlled electric blanket in detail, it is to be understood that the wirelessly-controlled electric blanket is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wirelessly-controlled electric blanket.

It is therefore important that the claims be regarded as including such equivalent construction insofar as they do not depart from the spirit and scope of the wirelessly-controlled electric blanket. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
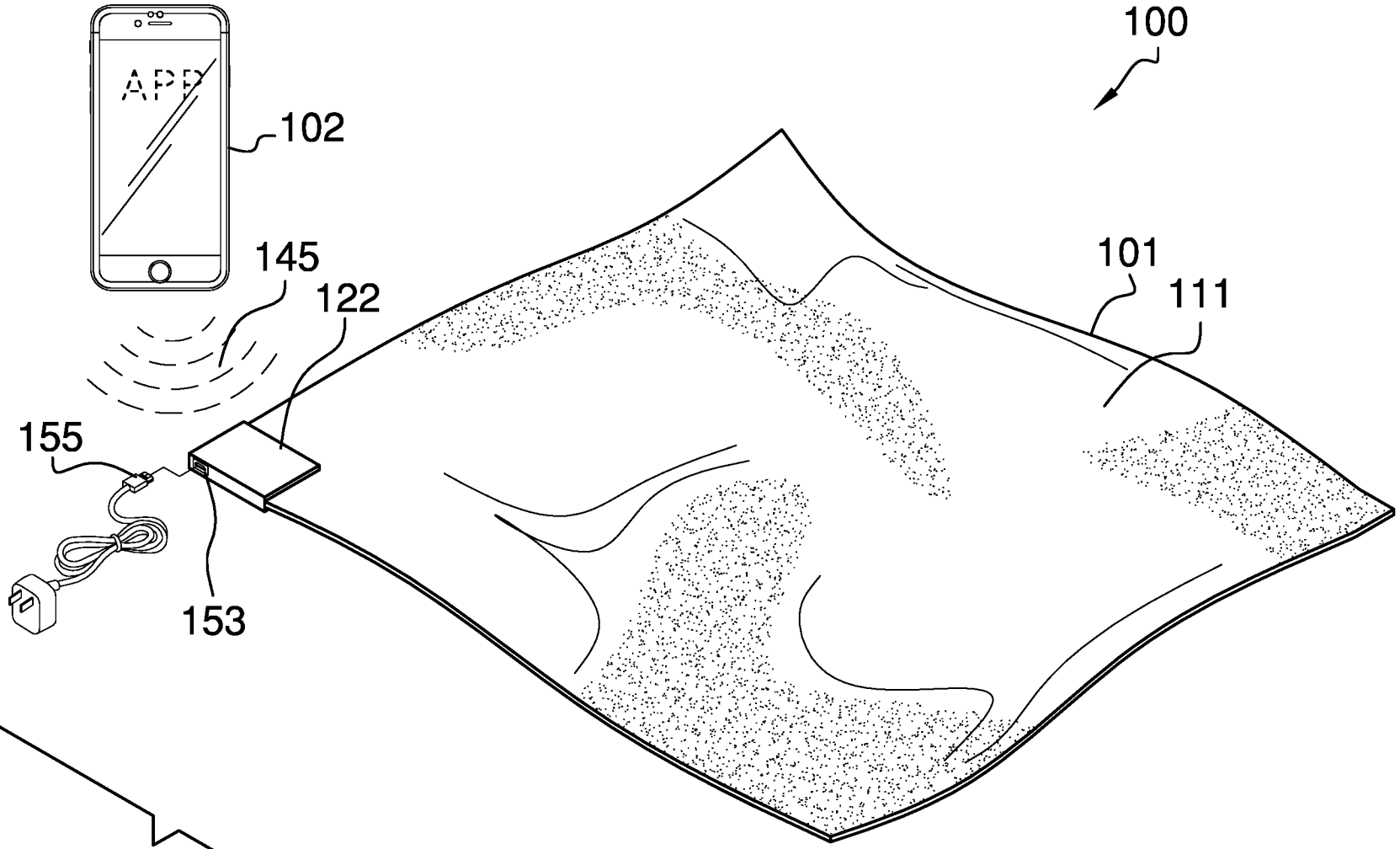
FIG. 1 is a perspective view of an embodiment of the disclosure.
Figure 2:
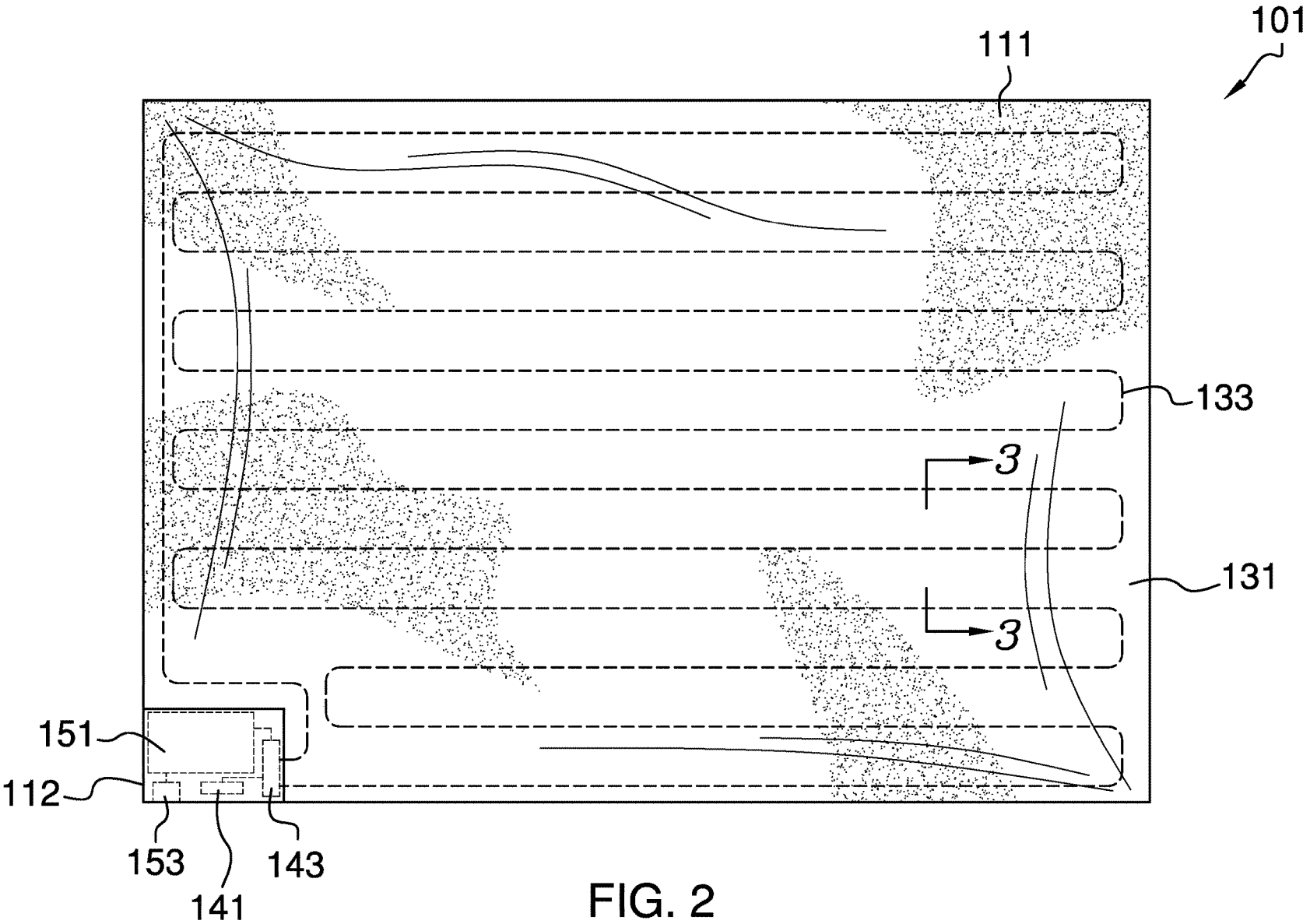
FIG. 2 is a top view of an embodiment of the disclosure.
Figure 3:
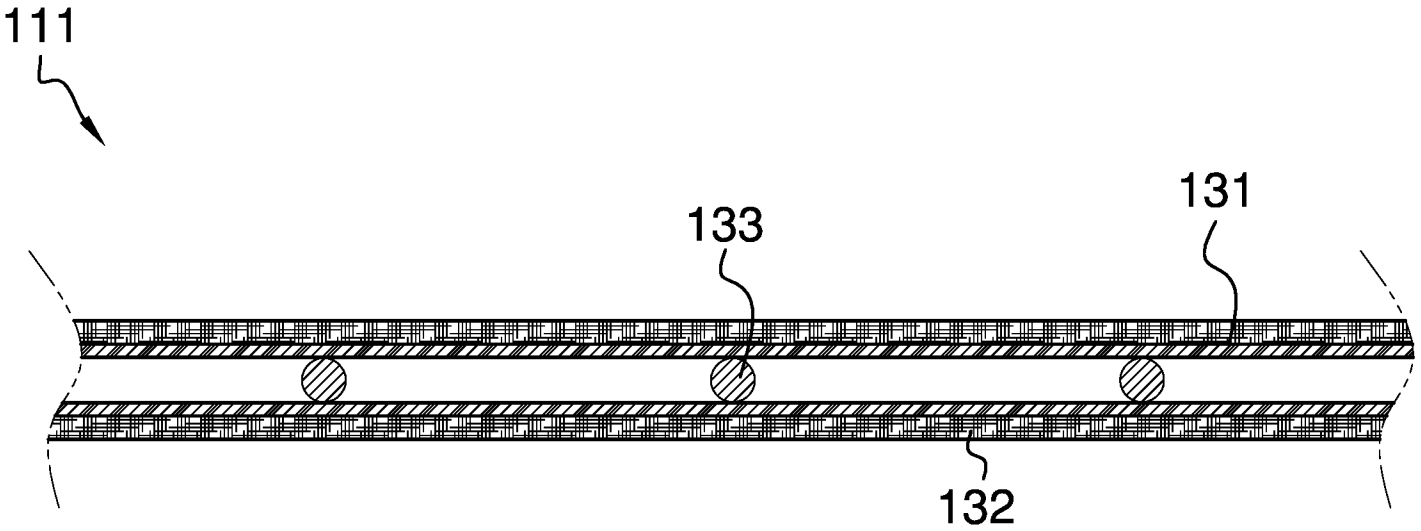
FIG. 3 is a cross-sectional view of an embodiment of the disclosure across 3-3 as shown in FIG. 2.
Figure 4:
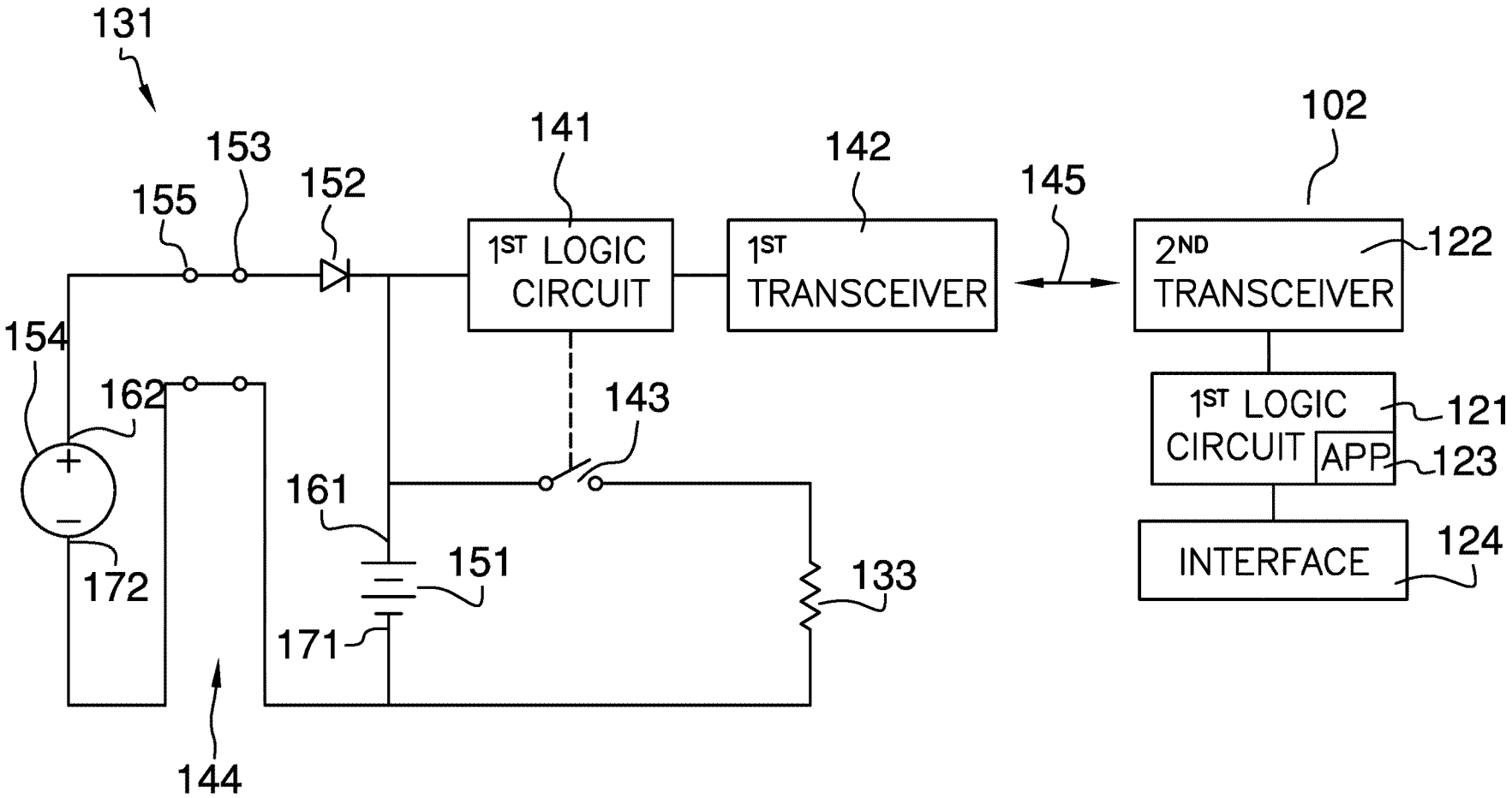
FIG. 4 is a block diagram of an embodiment of the disclosure.

Detailed reference will now be made to one or more potential embodiments of the disclosure, which are illustrated in FIGS. 1 through 4.

The wirelessly-controlled electric blanket 100 (hereinafter invention) is a domestic article. The invention 100 is textile structure known as a blanket 101. The invention 100 is an electrically powered device known as an electric blanket 101. The invention 100 is an independently powered electric device. By independently powered is meant that the invention 100 can operate without an electrical connection to an external electric power supply. The invention 100 comprises a blanket 101 and a personal data device 102. The personal data device 102 controls the operation of the blanket 101. The personal data device 102 forms a wireless communication link 145 with the blanket 101.

The personal data device 102 is a programmable electrical device that provides data management and communication services through one or more functions referred to as an application 123. The application 123 is a set of logical operating instructions that are performed by the personal data device 102. The addition of an application 123 will provide increased functionality for the personal data device 102. This disclosure assumes that an application 123 exists for the purpose of interacting with the invention 100. Methods to design and implement an application 123 on a personal data device 102 are well known and documented in the electrical arts.

The personal data device 102 comprises a second logic module 121 and a second transceiver 122. The second logic module 121 and the second transceiver 122 are electrically connected. The second logic module 121 is a readily and commercially available programmable electronic device that is used to manage, regulate, and operate the personal data device 102. The second transceiver 122 is a wireless electronic communication device that allows the second logic module 121 to wirelessly communicate with the heating circuit 112 of the blanket 101. Specifically, the second transceiver 122 establishes the wireless communication link 145 between the personal data device 102 and the first transceiver 142 of the heating circuit 112. In the first potential embodiment of the disclosure, the second transceiver 122 supports a communication protocol selected from the group consisting of a WiFi™ protocol or a Bluetooth™ protocol.

The second transceiver 122 is a radio frequency device that is provisioned with the personal data device 102. The second logic module 121 further comprises an application 123 and an interface 124. The application 123 sends operating instructions to the heating circuit 112 of the blanket 101 over the wireless communication link 145 using the second transceiver 122. The application 123 receives operating instructions from a user over the interface 124. The interface 124 is a user interface 124 that allows an individual to initiate the operation of the blanket 101 and to set operating the preferences temperatures of the blanket 101. This disclosure assumes that the application 123 provisions the interface 124.

The blanket 101 is a bedding item. The blanket 101 is a textile-based structure. The blanket 101 has a rectangular shape. The blanket 101 is an insulating structure that is commonly used to keep a person warm. The blanket 101 is an electrical device. The blanket 101 is an electrically heated device. The blanket 101 is an independently powered electric circuit. By independently powered is meant that the blanket 101 can operate without an electrical connection to an external power source 154. The blanket 101 comprises a composite textile 111 and a heating circuit 112. The heating circuit 112 attaches to the composite textile 111.

The composite textile 111 is a layered textile structure formed from a plurality of lamina. The composite textile 111 forms the insulating structure of the invention 100. The composite textile 111 generates the heat used to electrically heat the blanket 101. The composite textile 111 distributes heat across the faces of the textile structure of the composite textile 111. The composite textile 111 comprises a first textile sheeting 131, a second textile sheeting 132, and a heating element 133. The heating element 133 is enclosed between the first textile sheeting 131 and the second textile sheeting 132 to form the composite textile 111.

The first textile sheeting 131 is a textile-based sheeting commonly known as a fabric. The first textile sheeting 131 forms an exterior layer of the composite textile 111 of the blanket 101. The second textile sheeting 132 is a textile-based sheeting commonly known as a fabric. The second textile sheeting 132 forms an exterior layer of the composite textile 111 of the blanket 101.

The heating element 133 is an electrical device. The heating element 133 is an electrically powered resistive heating device. The heating element 133 generates the heat used to electrically heat the composite textile 111. The heating element 133 forms an interior layer of the composite textile 111. The heating element 133 is sandwiched between the first textile sheeting 131 and the second textile sheeting 132. The heating element 133 is a well-known and documented device in the electrical arts.

The heating circuit 112 attaches to the composite textile 111. The heating circuit 112 is an electric circuit. The heating circuit 112 generates the electrical energy necessary to heat the composite textile 111. The personal data device 102 controls the operation of the heating circuit 112. The heating circuit 112 is an independently powered electric circuit. By independently powered is meant that the heating circuit 112 can operate without an electrical connection to an external power source 154. The heating circuit 112 comprises a first logic module 141, a first transceiver 142, a controlling relay 143, and a power circuit 144. The first logic module 141, the first transceiver 142, the controlling relay 143, and the power circuit 144 are electrically interconnected. The first transceiver 142 further comprises a wireless communication link 145.

The first logic module 141 is a readily and commercially available programmable electronic device that is used to manage, regulate, and operate the heating circuit 112. The first transceiver 142 is a wireless electronic communication device that allows the first logic module 141 to wirelessly communicate with the personal data device 102. Specifically, the first transceiver 142 establishes a wireless communication link 145 between the heating circuit 112 and the second transceiver 122 of the personal data device 102. In the first potential embodiment of the disclosure, the first transceiver 142 supports a communication protocol selected from the group consisting of a WiFi™ protocol or a Bluetooth™ protocol.

The first transceiver 142 is a radio frequency device. The first logic module 141 receives operating instructions from the second transceiver 122 of the personal data device 102 over the wireless communication link 145. The first transceiver 142 transmits the received operating instructions to the first logic module 141. The first logic module 141 controls the operation of the controlling relay 143 based on the operating instructions received from the first transceiver 142.

The controlling relay 143 is an electrical switching device known as a relay. The controlling relay 143 is a switch that is wired between the power circuit 144 and the heating element 133. The controlling relay 143 is controlled by electrical signals generated by the first logic module 141. The first logic module 141 actuates the controlling relay 143 to a closed position in order to generate heat from the heating element 133. The first logic module 141 actuates the first transceiver 142 to an open position to discontinue the heating element 133 from generating heat.

The power circuit 144 comprises a battery 151, a diode 152, a charging port 153, and an external power source 154. The external power source 154 further comprises a charging plug 155. The battery 151, the diode 152, the charging port 153, the external power source 154, and the charging plug 155 are electrically interconnected. The battery 151 is further defined with a first positive terminal 161 and a first negative terminal 171. The external power source 154 is further defined with a second positive terminal 162 and a second negative terminal 172.

The power circuit 144 is an electrical circuit. The power circuit 144 powers the operation of the heating circuit 112. The power circuit 144 is an electrochemical device. The power circuit 144 converts chemical potential energy into the electrical energy required to power the heating circuit 112. The power circuit 144 is an independently powered electric circuit. By independently powered is meant that the power circuit 144 can operate without an electrical connection to an external power source 154.

The battery 151 is an electrochemical device. The battery 151 converts chemical potential energy into the electrical energy used to power the heating circuit 112. The battery 151 is a commercially available rechargeable battery 151. The chemical energy stored within the rechargeable battery 151 is renewed and restored through the use of the charging port 153. The charging port 153 is an electrical circuit that reverses the polarity of the rechargeable battery 151 and provides the energy necessary to reverse the chemical processes that the rechargeable battery 151 initially used to generate the electrical energy. This reversal of the chemical process creates a chemical potential energy that will later be used by the rechargeable battery 151 to generate electricity.

The charging port 153 forms an electrical connection to an external power source 154 using a charging plug 155. The charging plug 155 forms a detachable electrical connection with the charging port 153. The charging port 153 receives electrical energy from the external power source 154 through the charging plug 155. The diode 152 is an electrical device that allows current to flow in only one direction. The diode 152 installs between the rechargeable battery 151 and the charging port 153 such that electricity will not flow from the first positive terminal 161 of the rechargeable battery 151 into the second positive terminal 162 of the external power source 154. In the first potential embodiment of the disclosure, the external power source 154, the charging plug 155, and the charging port 153 are compatible with USB power requirements.

The following definitions were used in this disclosure:

Application or App: As used in this disclosure, an application or app is a self-contained piece of software that is especially designed or downloaded for use with a personal data device.

Battery: As used in this disclosure, a battery is a chemical device consisting of one or more cells, in which chemical energy is converted into electricity and used as a source of power. Batteries are commonly defined with a positive terminal and a negative terminal.

Bedding: As used in this disclosure, bedding refers to textile items use to cover or enclose the mattress or frame of a bed. Common bedding items include sheets, blankets, and pillow cases.

Bluetooth™: As used in this disclosure, Bluetooth™ is a standardized communication protocol that is used to wirelessly interconnect electronic devices.

Communication Link: As used in this disclosure, a communication link refers to the structured exchange of data between two objects.

Composite Textile: As used in this disclosure, a composite textile is a multilayer fabric made of two or more joined layers of textile or sheeting materials.

Diode: As used in this disclosure, a diode is a two terminal semiconductor device that allows current flow in only one direction. The two terminals are called the anode and the cathode. Electric current is allowed to pass from the anode to the cathode.

External Power Source: As used in this disclosure, an external power source is a source of the energy that is externally provided to enable the operation of the present disclosure. Examples of external power sources include, but are not limited to, electrical power sources and compressed air sources.

Heating Element: As used in this disclosure, a heating element is a resistive wire that is used to convert electrical energy into heat. Common metal combinations used to form heat elements include a combination of nickel and Chromium (typical: 80/20), a combination of iron, chromium and aluminum (typical 70/25/5), a combination of copper, nickel, iron, and manganese (typical 66/30/2/2) (use for continuously hot), and platinum.

Hot Lead and Neutral Lead: As used in this disclosure, a hot lead is the source of the electric current that is provided by a voltage source. A neutral lead is the return for the electric current that is provisioned through the hot lead back to the voltage source.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Interface: As used in this disclosure, an interface is a physical or virtual boundary that separates two different systems across which information is exchanged.

Lamina: As used in this disclosure, a lamina refers to an individual layer of a composite structure that is formed from a plurality of layers.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

PDD: As used in this disclosure, PDD is an acronym for personal data device.

Personal Data Device: As used in this disclosure, a personal data device is a handheld logical device that is used for managing personal information and communication. Examples of personal data device include, but are not limited to, cellular phones, tablets, and smartphones. See logical device Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Relay: As used in this disclosure, a relay is an automatic electronic, electromagnetic, or electromechanical device that reacts to changes in voltage or current by opening or closing a switch in an electric circuit. Relays are further defined with a coil and a switch. Applying a voltage to the coil, usually referred to as energizing the coil, will cause the coil to change the position of the switch. This definition is not intended to preclude the substitution of a transistor for a relay. Within this disclosure, a transistor can be considered as a relay. In this scenario, the base voltage is analogous to the coil of the relay and the current flow from the collector to the emitter is analogous to the operation of the switch of the relay. Those skilled in the electrical arts will recognize that this substitution can be made without undue experimentation. The transistor is defined in greater detail elsewhere in this disclosure.

Sheeting: As used in this disclosure, a sheeting is a material, such as a paper, textile, a plastic, or a metal foil, in the form of a thin flexible layer or layers.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Textile: As used in this disclosure, a textile is a material that is woven, knitted, braided or felted. Synonyms in common usage for this definition include fabric and cloth.

Transceiver: As used in this disclosure, a transceiver is a device that is used to generate, transmit, and receive electromagnetic radiation such as radio signals.

Transistor: As used in this disclosure, a transistor is a general term for a three-terminal semiconducting electrical device that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. This disclosure assumes the use of an NPN transistor. This assumption is made solely for the purposes of simplicity and clarity of exposition. Those skilled in the electrical arts will recognize that other types of transistors, including but not limited to, field effect transistors and PNP transistors, can be substituted for an NPN transistor without undue experimentation.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

WiFi™: As used in this disclosure, WiFi™ refers to the physical implementation of a collection of wireless electronic communication standards commonly referred to as IEEE 802.11x.

Wireless: As used in this disclosure, wireless is an adjective that is used to describe a communication channel between two devices that does not require the use of physical cabling.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wirelessly-controlled electric blanket comprising
a blanket and a personal data device;
wherein the personal data device controls the operation of the blanket;
wherein the wirelessly-controlled electric blanket is a domestic article;
wherein the wirelessly-controlled electric blanket is textile structure;
wherein the wirelessly-controlled electric blanket is an electrically powered device;
wherein the wirelessly-controlled electric blanket is an independently powered electric device;
wherein by independently powered is meant that the wirelessly-controlled electric blanket can operate without an electrical connection to an external electric power supply;
wherein the blanket comprises a composite textile and a heating circuit;
wherein the heating circuit attaches to the composite textile;
wherein the composite textile is a layered textile structure formed from a plurality of lamina;
wherein the composite textile forms the insulating structure of the wirelessly-controlled electric blanket;
wherein the heating circuit generates the heat used to electrically heat the blanket;
wherein the heating circuit distributes heat across the faces of the textile structure of the composite textile.

2. The wirelessly-controlled electric blanket according to claim 1 wherein the personal data device forms a wireless communication link with the blanket.

3. The wirelessly-controlled electric blanket according to claim 2
wherein the personal data device comprises a second logic module and a second transceiver;
wherein the second logic module and the second transceiver are electrically connected.

4. The wirelessly-controlled electric blanket according to claim 3
wherein the second logic module is a programmable electronic device;
wherein the second transceiver is a wireless electronic communication device that allows the second logic module to wirelessly communicate with the blanket;
wherein the second transceiver is a radio frequency device.

5. The wirelessly-controlled electric blanket according to claim 4
wherein the second logic module further comprises an application and an interface;
wherein the application sends operating instructions to the blanket over a wireless communication link using the second transceiver;
wherein the application receives operating instructions through the interface.

6. The wirelessly-controlled electric blanket according to claim 5 wherein the blanket is a bedding item;
wherein the blanket is a textile-based structure;
wherein the blanket has a rectangular shape;
wherein the blanket is an insulating structure.

7. The wirelessly-controlled electric blanket according to claim 6 wherein the blanket is an electrical device;
wherein the blanket is an electrically heated device;
wherein the blanket is an independently powered electric circuit;

wherein by independently powered is meant that the blanket can operate without an electrical connection to an external power source.

8. The wirelessly-controlled electric blanket according to claim 7 wherein the heating circuit is an electric circuit;

wherein the heating circuit generates the electrical energy necessary to heat the composite textile;

wherein the personal data device controls the operation of the heating circuit;

wherein the heating circuit is an independently powered electric circuit;

wherein by independently powered is meant that the heating circuit can operate without an electrical connection to an external power source.

9. The wirelessly-controlled electric blanket according to claim 8 wherein the composite textile comprises a first textile sheeting, a second textile sheeting, and a heating element;

wherein the heating element is enclosed between the first textile sheeting and the second textile sheeting to form the composite textile.

10. The wirelessly-controlled electric blanket according to claim 9 wherein the heating circuit comprises a first logic module, a first transceiver, a controlling relay, and a power circuit;

wherein the first logic module, the first transceiver, the controlling relay, and the power circuit are electrically interconnected;

wherein the first transceiver further comprises a wireless communication link;

wherein the second transceiver establishes the wireless communication link between the second transceiver of the personal data device and the first transceiver of the heating circuit.

11. The wirelessly-controlled electric blanket according to claim 10 wherein the first textile sheeting is a textile-based sheeting commonly known as a fabric;

wherein the first textile sheeting forms an exterior layer of the composite textile of the blanket;

wherein the second textile sheeting is a textile-based sheeting commonly known as a fabric;

wherein the second textile sheeting forms an exterior layer of the composite textile of the blanket.

12. The wirelessly-controlled electric blanket according to claim 11 wherein the heating element is an electrically powered resistive heating device;

wherein the heating element is sandwiched between the first textile sheeting and the second textile sheeting.

13. The wirelessly-controlled electric blanket according to claim 12 wherein the first logic module is a programmable electronic device.

14. The wirelessly-controlled electric blanket according to claim 13 wherein the first transceiver is a wireless electronic communication device;

wherein the first transceiver is a radio frequency device;

wherein the first logic module receives operating instructions from the second transceiver of the personal data device over the wireless communication link;

wherein the first transceiver transmits the received operating instructions to the first logic module;

wherein the first logic module controls the operation of the controlling relay based on the operating instructions received from the first transceiver.

15. The wirelessly-controlled electric blanket according to claim 14 wherein the controlling relay is a relay;

wherein the controlling relay is a switch that is wired between the power circuit and the heating element;

wherein the controlling relay is controlled by electrical signals generated by the first logic module;

wherein the first logic module actuates the controlling relay to a closed position in order to generate heat from the heating element;

wherein the first logic module actuates the first transceiver to an open position to discontinue the heating element from generating heat.

16. The wirelessly-controlled electric blanket according to claim 15 wherein the power circuit is an electrical circuit;

wherein the power circuit powers the operation of the heating circuit;

wherein the power circuit is an electrochemical device;

wherein the power circuit converts chemical potential energy into the electrical energy required to power the heating circuit;

wherein the power circuit is an independently powered electric circuit;

wherein by independently powered is meant that the power circuit can operate without an electrical connection to an external power source.

17. The wirelessly-controlled electric blanket according to claim 16 wherein the power circuit comprises a battery, a diode, a charging port, and an external power source;

wherein the external power source further comprises a charging plug;

wherein the battery, the diode, the charging port, the external power source, and the charging plug are electrically interconnected;

wherein the battery is further defined with a first positive terminal and a first negative terminal;

wherein the external power source is further defined with a second positive terminal and a second negative terminal.

18. The wirelessly-controlled electric blanket according to claim 17 wherein the battery is an electrochemical device;

wherein the battery is a rechargeable battery;

wherein the charging port is an electrical circuit that reverses the polarity of the rechargeable battery and provides the energy necessary to reverse the chemical processes that the rechargeable battery initially used to generate the electrical energy;

wherein the charging port forms an electrical connection to an external power source using the charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

* * * * *